United States Patent [19]

Stein et al.

[11] Patent Number: 5,076,511

[45] Date of Patent: Dec. 31, 1991

[54] DISCRETE IMPULSE SPINNING-BODY HARD-KILL (DISK)

[75] Inventors: Gunter Stein, New Brighton; Dennis L. Kurschner, Minnetonka; Jeffrey M. Burrows, Minneapolis, all of Minn.

[73] Assignee: Honeywell Inc., Minneapolis, Minn.

[21] Appl. No.: 631,300

[22] Filed: Dec. 19, 1990

[51] Int. Cl.[5] ..... F42B 10/66

[52] U.S. Cl. ..... 244/3.22; 102/384

[58] Field of Search ..... 244/3.22, 3.21, 3.16, 244/3.15; 102/384

[56] References Cited

U.S. PATENT DOCUMENTS

| | | | |
|---|---|---|---|
| 2,980,363 | 4/1961 | Schonstedt | 244/3.22 |
| 3,216,674 | 11/1965 | McLean | 244/3.16 |
| 3,461,801 | 8/1969 | Vitale et al. | 102/393 |
| 3,568,954 | 3/1971 | McCorkle. Jr. | 244/3.22 |
| 3,758,052 | 9/1973 | McAlexander et al. | 244/3.22 |
| 3,937,423 | 2/1976 | Johansen | 244/3.22 |
| 3,979,085 | 9/1976 | Leonard | 244/3.22 |
| 3,983,783 | 10/1976 | Maxey | 89/1.819 |
| 4,143,836 | 3/1979 | Rieger | 244/3.15 |
| 4,147,066 | 4/1979 | Bard | 244/3.22 |
| 4,172,407 | 10/1979 | Wentink | 102/393 |
| 4,300,736 | 11/1981 | Miles | 244/3.22 |
| 4,342,262 | 8/1982 | Romer et al. | 102/489 |
| 4,356,770 | 11/1982 | Atanasoff et al. | 102/384 |
| 4,372,216 | 2/1983 | Pinson et al. | 102/489 |
| 4,384,690 | 5/1983 | Brodersen | 244/3.22 |
| 4,444,117 | 4/1984 | Mitchell, Jr. | 102/489 |
| 4,455,943 | 6/1984 | Pinson | 102/489 |
| 4,470,562 | 9/1984 | Hall et al. | 244/3.22 |
| 4,498,393 | 2/1985 | Fischer et al. | 102/393 |
| 4,553,718 | 11/1985 | Pinson | 244/3.15 |
| 4,560,120 | 12/1985 | Crawford et al. | 244/3.22 |
| 4,562,980 | 1/1986 | Deans et al. | 244/3.22 |
| 4,568,040 | 2/1986 | Metz | 244/3.22 |
| 4,623,107 | 11/1986 | Misöph | 244/3.22 |
| 4,625,646 | 12/1986 | Pinson | 102/489 |
| 4,645,139 | 2/1987 | Guillot et al. | 244/3.22 |
| 4,659,036 | 4/1987 | Pinson | 244/3.22 |
| 4,674,408 | 6/1987 | Stessen | 102/384 |
| 4,676,167 | 6/1987 | Huber, Jr. et al. | 102/393 |
| 4,928,906 | 5/1990 | Sturm | 244/3.22 |

FOREIGN PATENT DOCUMENTS 1444029 7/1976 United Kingdom .

*Primary Examiner*—Charles T. Jordan

*Attorney, Agent, or Firm*—Merchant, Gould, Smith, Edell, Welter & Schmidt

[57] ABSTRACT

A weapon deliver/target interceptor (DISK) comprising a spinning right circular cylinder maneuvered by thrusters located about the periphery of the cylinder's circumference. The cylinder is guided by means of a forward looking sensor mounted on the front face of the cylinder and a guidance system which senses the rotational acceleration and precessional acceleration.

20 Claims, 12 Drawing Sheets

DISCRETE IMPULSE SPINNING-BODY HARD-KILL (DISK)

FIELD OF THE INVENTION

DISK is a weapon delivery/target interceptor comprising a spinning right circular cylinder. More particularly, DISK is a cylinder capable of intercepting airborne targets and eliminating them.

BACKGROUND OF THE INVENTION

The introduction of guided weapons on the modern battlefield has permanently altered the character of conventional warfare. Guided weapons have been developed and deployed successfully in a variety of Army, Navy and Air Force applications which include anti-armor and anti-air. Less successfully, guided weapons have been examined for application to active armor and other self-defense roles. The major drawback to current guided weapon systems is cost related, typically ranging into hundreds of thousands of dollars, therefore, their usage on the modern battlefield has been limited.

The DISK concept was initially inspired as a very low cost approach to meet self-defense requirements The primary initial objective was to develop a design with good terminal accuracy (0.1 to 1 meter) and an appropriate response time (1 to 5 seconds), at a unit production cost of no more than a few thousand dollars. High maneuverability was not an initial design objective since the self-defense mission does not require it. However, the emerging design concept exhibited surprising theoretical maneuverability as well, opening up the additional potential for its employment in a number of counter-air applications.

The basic DISK design concept was originally filed Oct. 23, 1990 in commonly owned copending application entitled "Navigation Method for Spinning Body and Projectile Using Same", Ser. No. 07/602,179, on behalf of James C. Harris and is hereby incorporated by reference . This application is an improvement upon the original commonly owned copending Application. The major drawbacks of the original design include that the original design requires the moment of inertia ratio be an integer with an allowable error of $+/-10\%$. The possibility of having a moment of inertia ratio of "1" would require that the DISK be a perfect sphere, a moment of inertia ratio of "2" would require that the DISK device be a ring. A moment of inertia ratio higher than "2" is impossible. Thus, by building to these design restraints it becomes difficult to build practical hardware. Secondly, the original system is based on the theory of discrete proportional navigation. The original design requires the device to complete three full rotations for each maneuver cycle. The first rotation is to acquire the target location, the second is to determine the angle of line-of-sight change and the third is to allow one of the discrete solid propulsion thrusters to correct for the line-of-sight error. The current original method of calculating this error requires a complex electrical circuit or a microcomputer to properly calculate the error. Although this system is complex, it is still operational. However, this application discloses a great and novel improvement upon the original design.

SUMMARY OF THE INVENTION

DISK is a munition system for intercepting a target wherein the system comprises a base platform dispenser, a right circular cylinder having a circular periphery, forward and back parallel end faces and a longitudinal axis. Wherein the dispenser includes a means for spinning the cylinder about the longitudinal axis and for launching the spinning cylinder along a preselected path with the longitudinal axis being in a preselected orientation. The cylinder comprises a controllable propulsion means located about the periphery of the cylinder. The controllable propulsion means may either be a continuous propulsion means or discrete solid propellant thrusters. The target sensing means is located on the forward end face of the cylinder. The sensor has a fan-shaped field-of-view which returns the attitude angle measurement between the cylinder and the target once per revolution when the line-of-sight to an observed target object passes through the field-of-view. The cylinder further comprises a magnetometer. The magnetometer is located within the cylinder, and as the cylinder rotates, the magnetometer senses rotational motion. This is accomplished due to the inherent locally homogeneous magnetic field of the earth and the inherent characteristics of an air coil which can sense these flux densities. The cylinder further comprises a proportional navigation means. The navigation means comprises a plurality of accelerometer pairs. The first and second accelerometer pairs are positioned upon the X and Y axes such that they sense precessional motion as the cylinder rotates about its longitudinal axis. The proportional navigation means then combines the measured precessional motion with the measured rotational motion to calculate the line-of-sight error for the target sensing means. By correcting for the precessional and rotational error the DISK device is able to position itself with its thrusting means in such a manner that it will intercept its target.

DESCRIPTION OF PREFERRED EMBODIMENT

Figure 1:
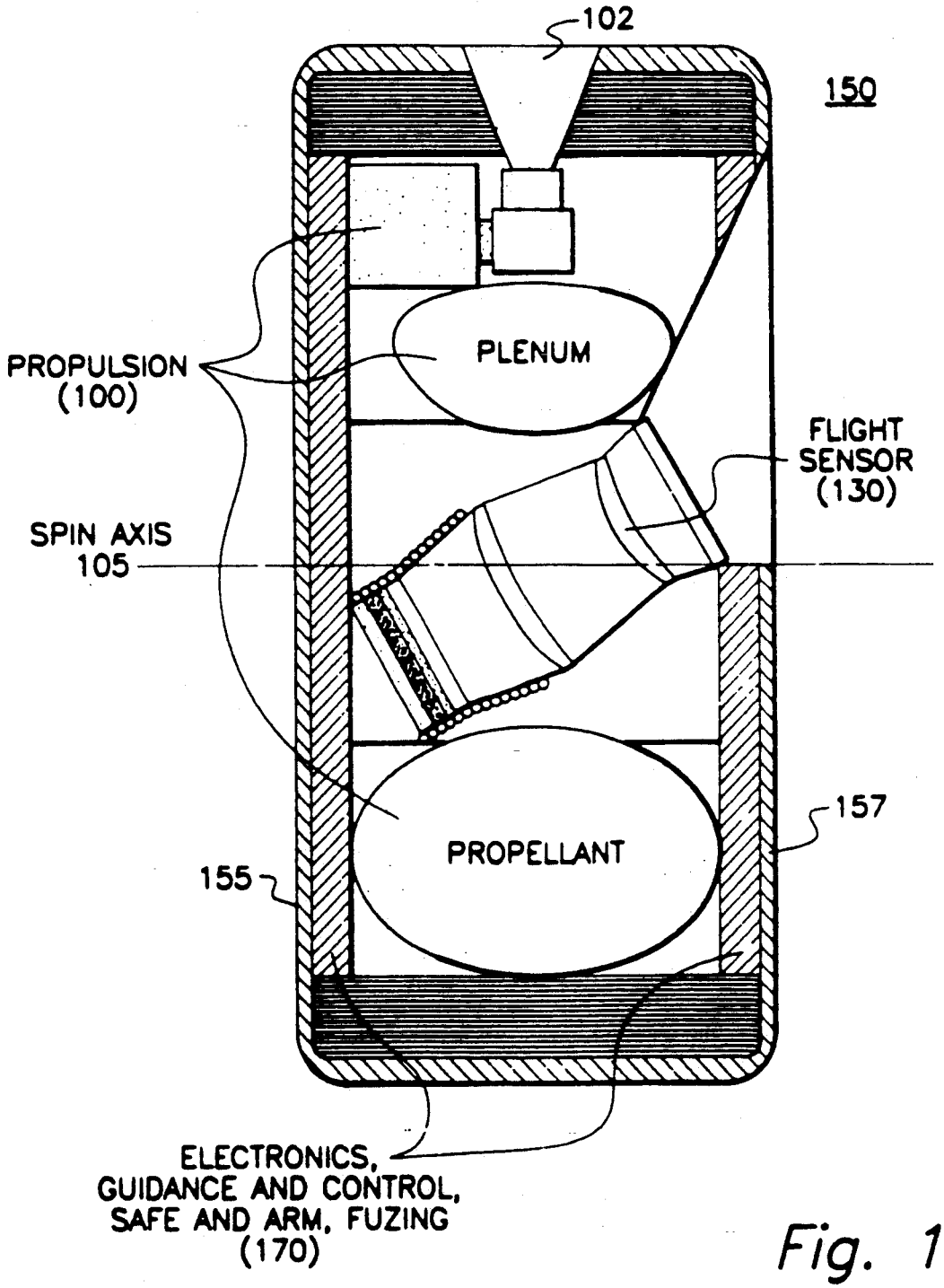
FIG. 1 demonstrates the position of the components within the cylinder.

The DISK device may be characterized as three separate systems interrelated in such a manner that the DISK device is propelled to a position where it may intercept an oncoming target. The three separate systems, as shown in FIG. 1, comprise a propulsion means 100, a sensor means 130 and a navigation means 170. FIG. 1 shows the positioning of each of these systems. Propulsion means 100 is located about the periphery of the cylinder's outer radius. Sensor means 130 is located on axis 105 and looks out forward end face 157 of DISK Sensor means 130 has a fan-shaped field-of-view which returns an attitude angle measurement once per revolution, about spin axis 105, when DISK's line-of-sight to the target passes through DISK's field-of-view. In this manner each revolution, the target is reacquired. Navigation means 170 is located inside of the forward 157 and rear 155 end faces of cylinder 150. DISK further comprises a plurality of thrusters 102 located about the periphery of cylinder 150. Thrusters 102 are fired such that they will move DISK to a position which will intercept the oncoming target. DISK movement is omnidirectional, within one plane.

Sensor 130 must be a forward looking sensor capable of reacquiring a target with each revolution. An infrared sensor is most adaptable to this system as it is effective day or night. Infrared sensor technology is also capable of distinguishing several targets and locking on a single target. The sensor utilized in this application was originally filed Dec. 14, 1990, in commonly owned copending application entitled, "Infrared Sensor for Short Range Detection of Aircraft", Ser. No. 07/629,294, on behalf of Patrick D. Pratt and Douglas B. Pledger, and is hereby incorporated by reference. The infrared sensor for this embodiment will be further explained in FIGS. 6–13.

A key requirement for the psuedo-inertial calculation is knowledge of reference times $t_{oi}$, at which the spinning platform nominally returns to its previous spin position. These times are provided by zero crossings of periodic signals from a magnetometer coil spin sensor 175 of FIG. 2. These crossings are calibrated relative to the down direction when DISK is initially launched from the base platform.

The basic concept for magnetic spin sensor 175 comes about due to the inherent characteristic of an air search coil. The voltage produced by an air coil moving in the earth's field is proportional to the number of coil turns and apparent change of flux;

$$v = N\frac{d\phi}{dt},$$

Where $\phi$ is flux and N=# of turns of the coil Since $$\phi = BA,$$

Where B=flux density and A=Area, $$v = NA\frac{dB}{dt} + NB\frac{dA}{dt}$$

Since the earth's field is essentially constant over the localized areas and short times of the typical DISK missions, this equation reduces to:

$$v = NA\frac{dA}{dt}, \text{ as } \frac{dB}{dt} = 0.$$

Therefore, voltage v is proportional to the periodic geometrical coupling of the coil to the earth's field (dA/dt) as it spins. The geometrical coupling repetition period is exactly proportional to DISK spin frequency and, likewise, the resulting analog coil voltage. In other words, the frequency of voltage v from magnetometer coil 175 is proportional to the spin rate of the DISK device. Further, due to the essentially constant magnetic field of the earth and low-noise high accuracy circuit technology, the magnetometer is accurate within 0.1%.

Figure 2:
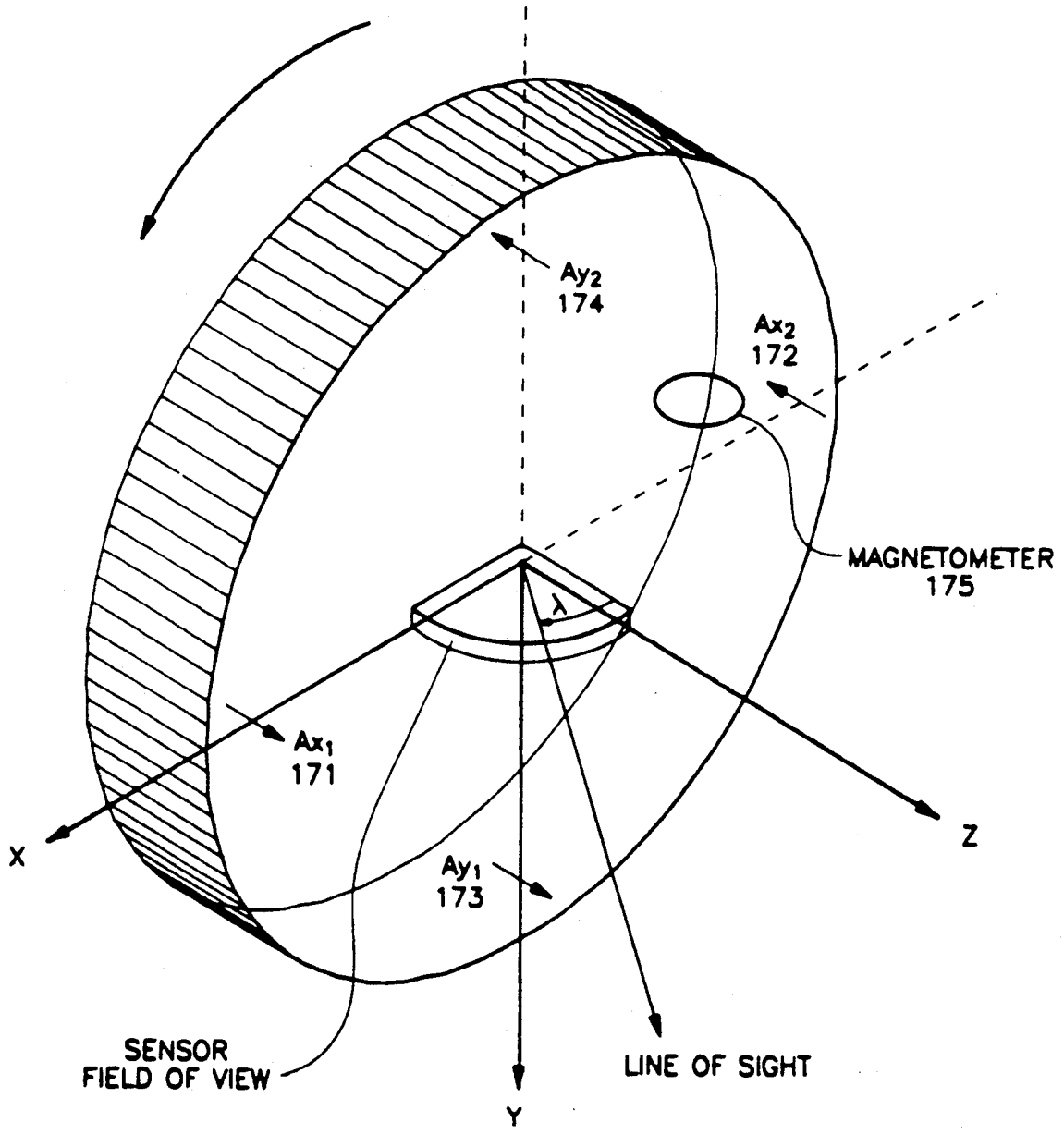
FIG. 2 demonstrates the position of the accelerometer pairs.
Figure 3:
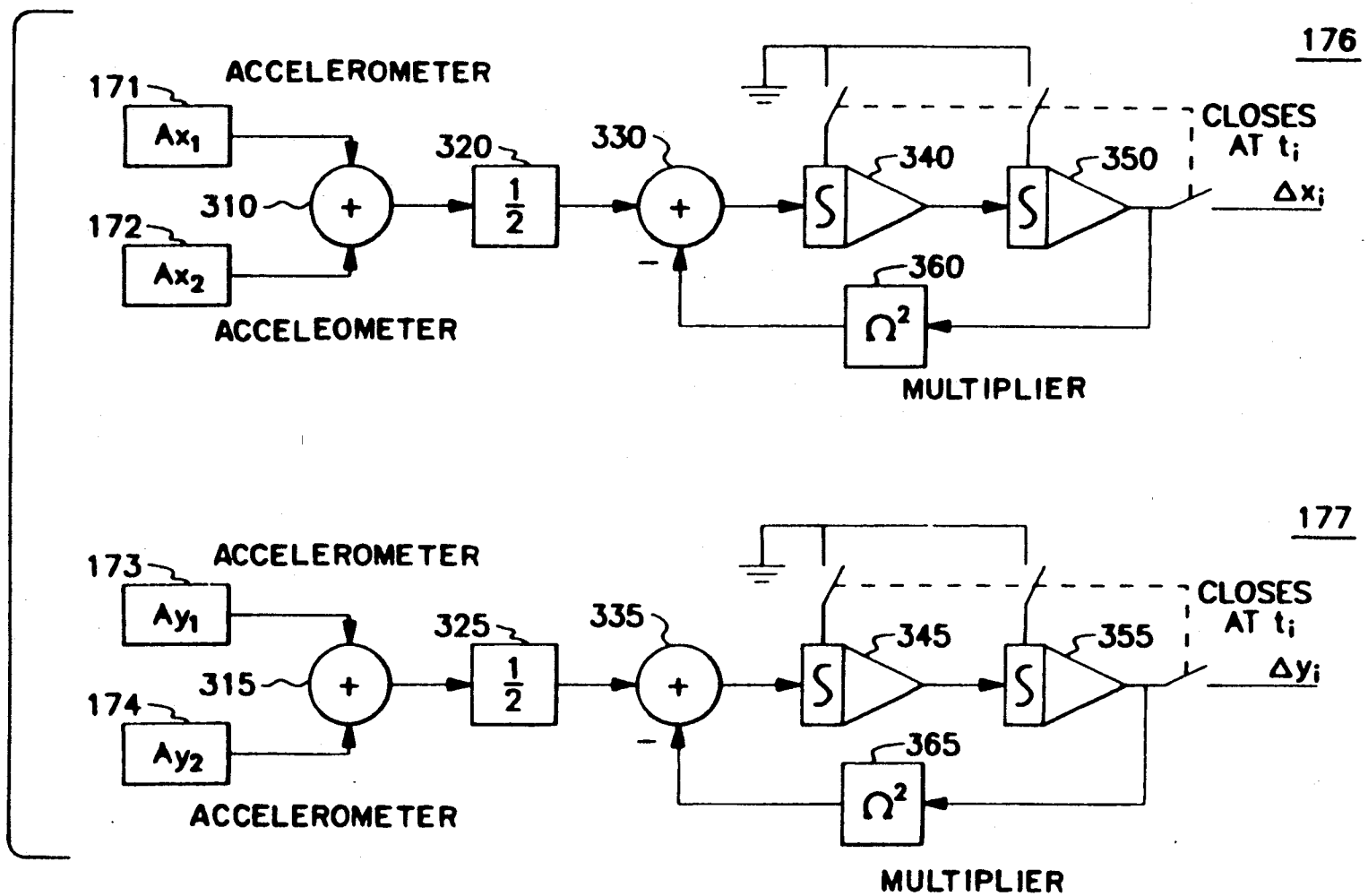
FIG. 3 is a simplified integrated circuit for calculating $\Delta x$ and $\Delta y$.

A second major error mechanism which corrupts the attitude angle measurements scheme is precessional motion of the spinning platform. A means for measuring the precessional error was introduced in the Harris application. During flight, the platform's body-z axis does not remain aligned with its spin axis, but differs by an unknown precession angle whose magnitude varies over time due to environment disturbances, thruster misalignment, spin rate changes, etc. This precession motion directly corrupts the angle and timing measurements. DISK calculates the line-of-sight angle, $\lambda$, that the target is off the z-axis and is thus sensitive to precessional errors. Precession errors are corrected by two functional circuits shown in FIG. 3. These circuits use two accelerometer pairs, $A_{x1}$ 171, $A_{x2}$ 172 and $A_{y1}$ 173, $A_{y2}$ 174, aligned with their sensitive axes along the body-z axis, and located on the body-x and body-y axes as shown in FIG. 2. The accelerometers are supplied by Endevco, San Juan Capistrano, Calif. Each accelerometer is connected in opposition to the accelerometer in its respective couple. Outputs of the accelerometers in each couple are summed to remove common-mode linear accelerations and then pass through the second-order oscillator filter 176 and 177 shown in FIG. 3. The frequency of filter 176 and 177 is equal to the platform spin rate, $\Omega$. Filter 176 is a second-order oscillator filter. Filter 176 samples the outputs from accelerometers 171 and 172, and a first summing means 310 sums the outputs together. The sum is then divided in half by a dividing means 320 and input into a second summing means 330. The output of summing means 330 is input into a first integrator 340, integrator 340 then provides its signal to a second integrator 350. The output of second integrator 350 is then provided to a feedback loop in which the output of second integrator 350 is multiplied by $\Omega^2$ (spin rate squared) by multiplying means 360. The output from multiplier 360 is then provided to the second summing circuit 330. The output of second integrator 350 is equivalent to $\Delta x_i$. Filter 177 is similar to filter 176 with the difference being that filter 177 samples the outputs from accelerometer 173 and accelerometer 174. The outputs of accelerometers 173 and 174 are input into first summing circuit 315. The output of summing circuit 315 is divided in half by divider 325 and provided to second summing means 335. Second summing means 335 provides a signal to first integrator 345, first integrator 345 integrating the signal from summing means 335 and providing its output to second integrating means 355. Integrating means 355 providing its signal to a multiplier 365, the multiplier again being $\Omega^2$, the output of multiplier 365 being supplied to second summing means 335. The output of the integrating means is also equivalent to $\Delta y_i$. Filter 176 and 177 is sampled at target crossing times and initial conditions are reset to zero immediately after sampling. The samples thus obtained are direct measurements of the differences between precession errors at time $t_i$ and time $t_{i-1}$ and are used to correct attitude rate estimates from the sensing system in accordance with the precession compensation equations:

$$\frac{dLx}{dt} \approx \frac{Lx_i - Lx_{i-1} - \Delta x_i}{\Delta t}$$

$$\frac{dLy}{dt} \approx \frac{Lx_i\,\Omega[(t_i - t_{i-1}) - (t_{oi} - t_{oi-1})] - \Delta y_i}{\Delta t}$$

where $vt = t_{oi} - t_{oi-1}$

Lx = Line-of-sight component on body-x = sin λ

Ly = Line-of-sight component on body-y

This error correction scheme works correctly for changing moment of inertia ratios of the platform, and for changes in spin rate, including maintaining accuracy in the same rotation period as thruster firings. Spin rate changes are accommodated by resetting the oscillator filter's frequency in inverse proportion to the measured reference time differences utilizing the simplified circuits shown in FIG. 3. Compensation for precessional error and rotational error may be accomplished with the use of a simple calculating means in accordance with the formula above.

For the compensation circuit to operate correctly, the spin rate Ω must be measured with an error no greater than 0.1%. As stated above, this requirement is met through the use of magnetometer coil 175 of FIG. 2. The magnetometer coil 175 is inherently accurate due to the consistent flux geometries of the earth's magnetic field in a localized area.

Figure 4:
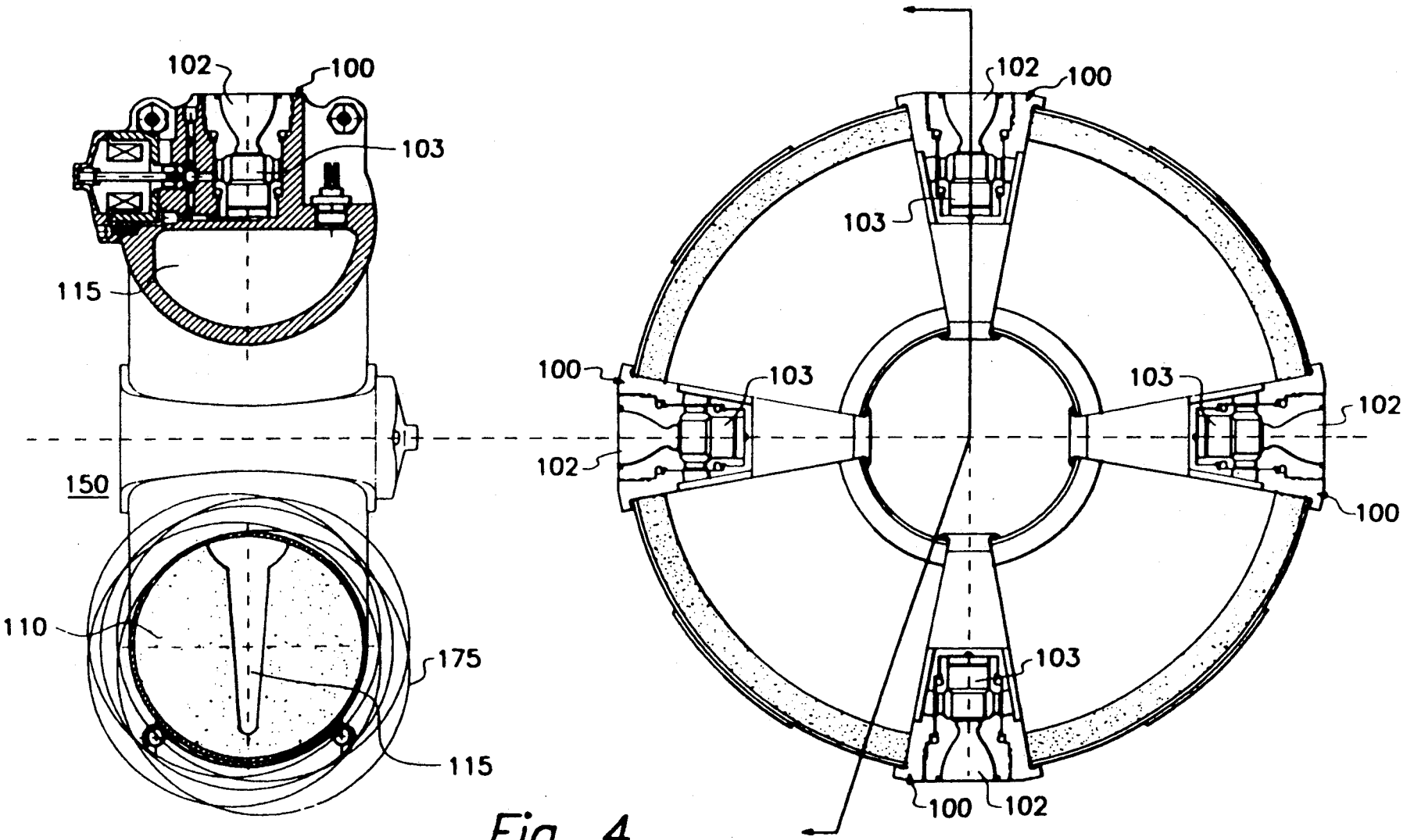
FIG. 4 demonstrates the positioning of the propulsion means.

Magnetometer 175 of FIG. 2 is wound around Propellant 110 container of FIG. 4 thus reducing the space required for electronics.

FIG. 4 demonstrates the propulsion means used to propel DISK within its plane. Propulsion means 100 is a reaction jet system. The reaction jet system has four jets 102 with solenoid controlled valves 103. The reaction jet valves are supplied by Moog Inc., East Aurora, N.Y. The reaction jet further comprises a propellant 110 and a plenum 115. Propellant 110 is ammonium nitrate. The gas generators comprising the propellant 110 and plenum 115 are supplied by Talley Defense Systems, Mesa, Ariz. Propellant 110 upon being ignited produces a high pressure gas, the high pressure gas is vented to plenum 115 which is in contact with each solenoid controlled valves 103 of jets 102. In this manner, the propulsion gas is available to all four jets 102. Navigation means 170 (FIG. 1) then controls valves 103 and opens and closes valves 103 as jet 102 rotates to a position whereby jet 102 will propel DISK or decelerate DISK as necessary towards the target interception. At least one valve 103 must be open at all times as propellant 110 upon being ignited constantly outputs a high pressure gas. Neutral propulsion (or zero propulsion) is produced by opening two opposing valves simultaneously.

Figure 5:
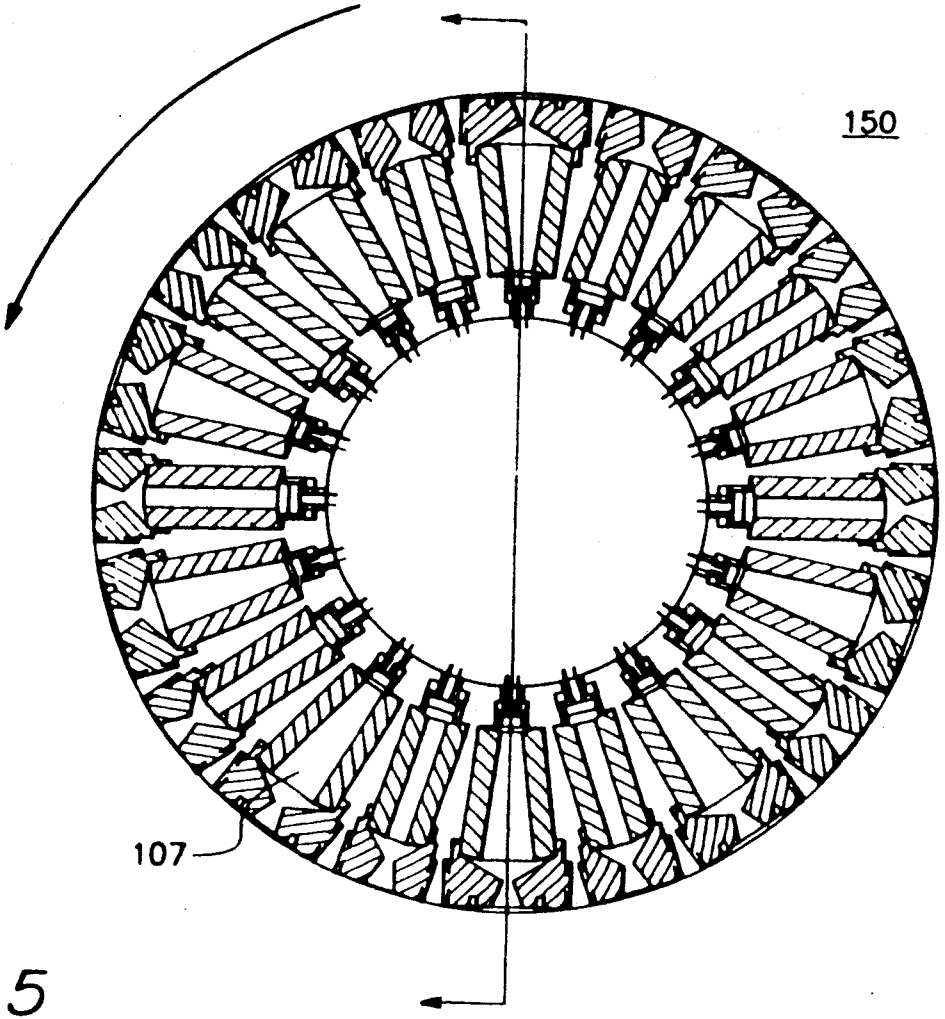
FIG. 5 demonstrates the use of solid propellant thrusters.
Figure 5:
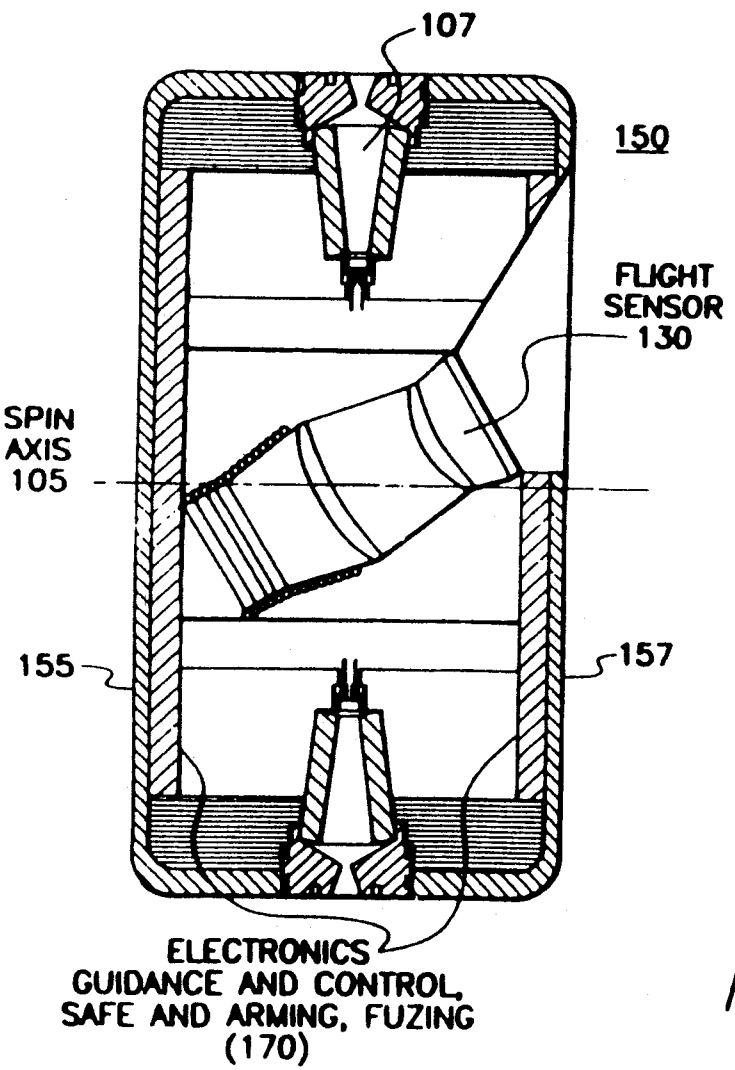

FIG. 5 demonstrates an alternative to the reaction jet propulsion means. For this embodiment the principles of control are similar to those of the previous embodiment, however, impulse thrusters are used as an alternative. Impulse thrusters 107 are located in an array around the circumference of DISK 150. The impulse thrusters are supplied by Morton Thiokol, Inc., Elkton, Md. The forces produced act through DISK's center of gravity at right angles to spin axis 105. The previous stated algorithms allows DISK to fire up to four thrusters 107 per revolution while continuing the guidance calculations. Whereby thruster 107 will propel DISK towards the target (or decelerate as required).

Figure 6:
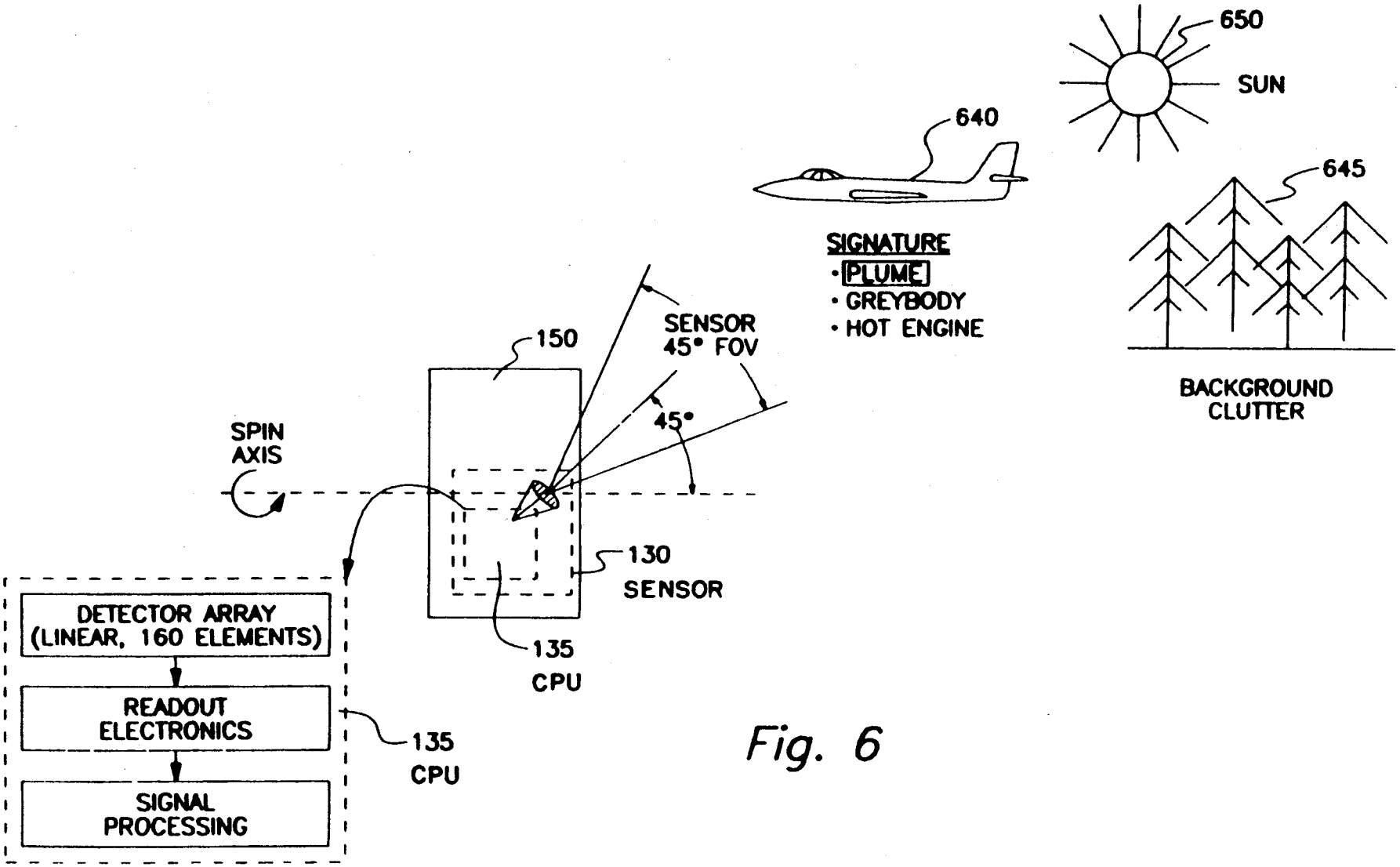
FIG. 6 illustrates the environment in which the infrared sensor must operate.

FIG. 6 demonstrates the environment which the sensor operates within. Sensor 130 is located within DISK 150 such that sensor 130 has a doughnut-shaped field of regard. Sensor 130 sweeps through the entire doughnut-shaped field of regard each revolution of DISK 150. As stated earlier, DISK 150 has precessional motion while it is rotating. In this manner the elements of sensor's array (not shown) will not focus on the same image on two successive revolutions.

Sensor's 130 field of view shall include the target with background clutter which shall include trees 645, sun 650 and other natural objects. The optimum target signature that sensor 130 searches for is the exhaust from an aircraft 640. However, sensor 130 will also pick up black body radiation from hot engine components.

A central processing unit 135 (CPU) is utilized to process the sensor information. The CPU 135 processes the information by comparing the data provided from both guard band array 610 and target detect array 620 of FIG. 7. The manner in which the information from the two arrays is compared is described later in the specifications.

Figure 7:
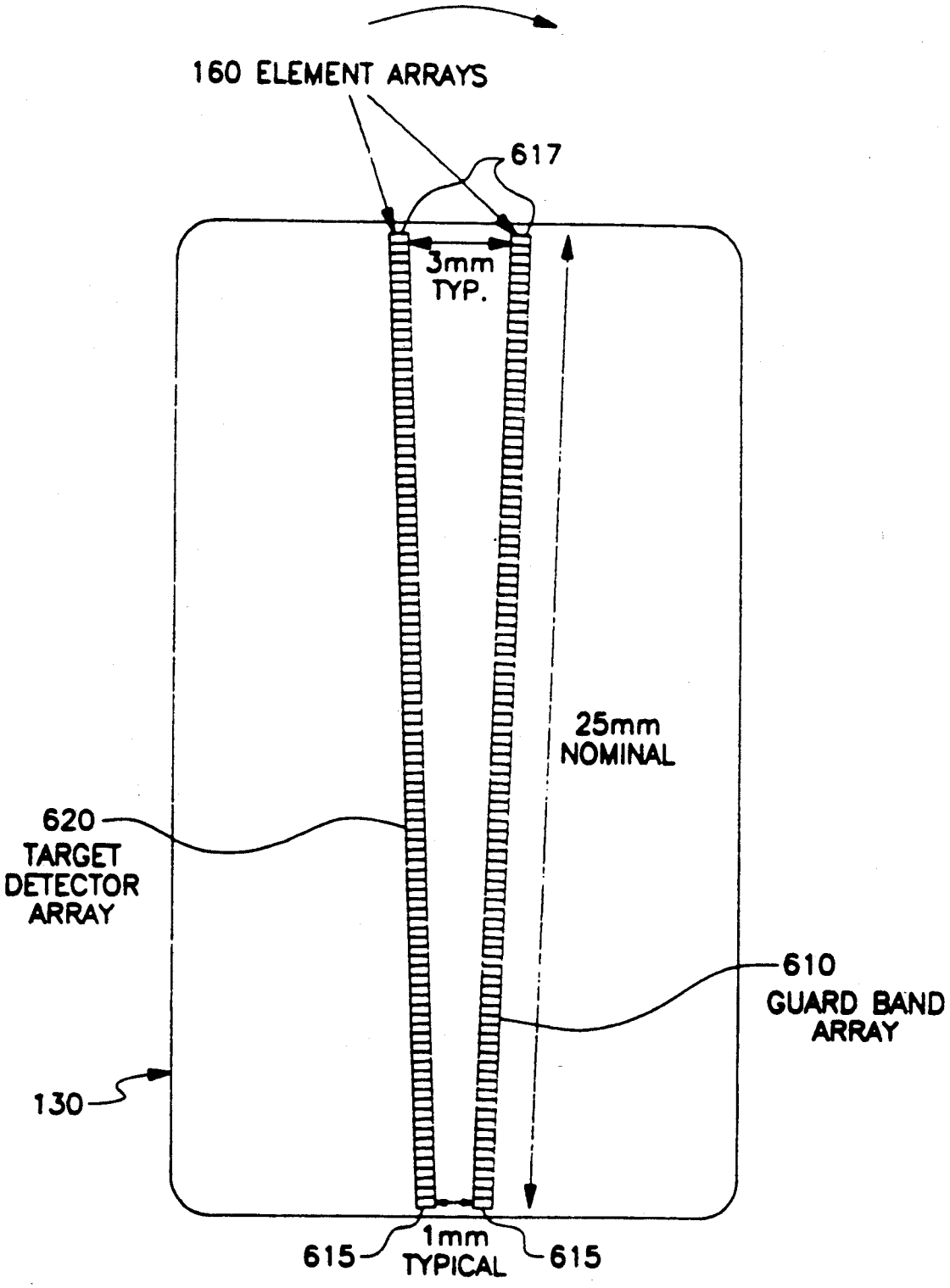
FIG. 7 demonstrates the placement of the two 160 element arrays in the sensor.

FIG. 7 shows the placement of the 160 element arrays 610 and 620. Sensor 130 incorporates a guard band array 610 and a target band array 620. Each array is comprised of 160 elements. The guard band array 610 is positioned such that guard band array 610 leads target detect array 620 as DISK 150 (not shown) rotates. Both guard band array 610 and target detect array 620 are in the same plane. Therefore, if one of the elements of guard band array 610 should detect the sun, the similar element on target detect array 620 will be prevented from tracking a false target. Each array has a 43% fill factor and is equipped with a binary field micro lens array (725 of FIG. 8) which will approximately quadruple the effect of energy collection area of each element. The overall array length is 2.5 centimeters and the detectors are aligned in the radial planes of rotation of the platform with inner ends 615 separated by 1 millimeter and outer ends 617 separated by 3 millimeters. The resulting angle of separation between the arrays is approximately 4.5°. The linear arrays will be hard wired to a multiplexer or CCD readout for scanning capability. Each array completes a sweep every 50 milliseconds. Both the guard band array 610 and the target detect array 620 can be purchased from Cincinnati Electronics Corp., Mason, Ohio.

Figure 8:
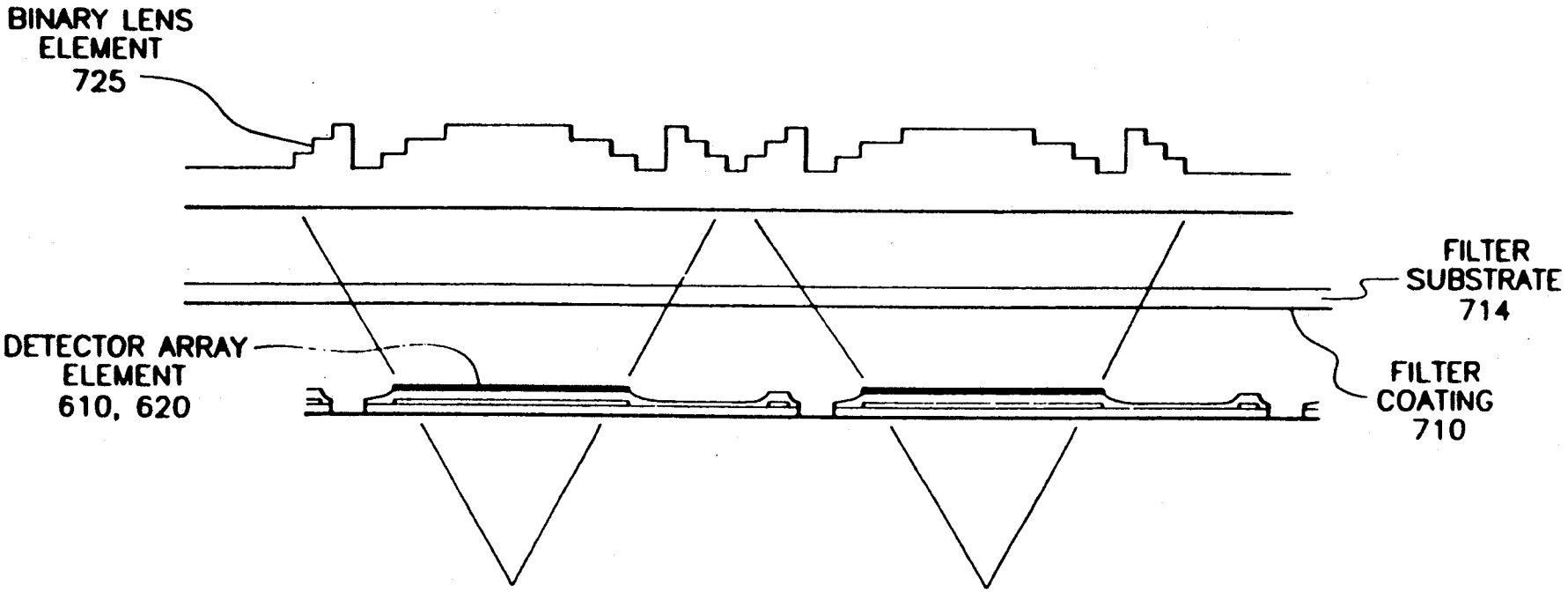
FIG. 8 illustrates the placement of the binary micro lens array and the filter with respect to the detector array.

FIG. 8 shows the placement of a binary field micro lens element 725, a filter substrate 714 and filter coating 710 relative to detector array 610 and 620. There are several important considerations in choosing the placement of the filters. They must be close enough to the sensor arrays to assure no crosstalk between transmitting bands. For this embodiment substrate 714 is inserted with filters coating 710 immediately adjacent to the detector array. The second surface of substrate 714 holding the filters should be antireflection (AR) coated for 4.2 μm.

Guard band array 610 is utilized to prevent false signals. Guard band array 610 is designed to have filter 710 pass energy from 1 micron to 4 microns. Such a filter is fabricated by depositing alternate low and high index of refraction materials according to the following design:

$$\text{substrate: } \left(\frac{H}{2} L \frac{H}{2}\right)^n : \text{air}$$

where H and L are quarter wave optical thicknesses of the high and low index materials respectively, and n is an integer representing the number of periods to be deposited. There are many materials that could be used for a short wave pass band filter with long wave edge at 4 μm. For this embodiment germanium is used for the high index ($n \approx 4$) and ZnS for the low index ($n \approx 2.2$).

Figure 9:
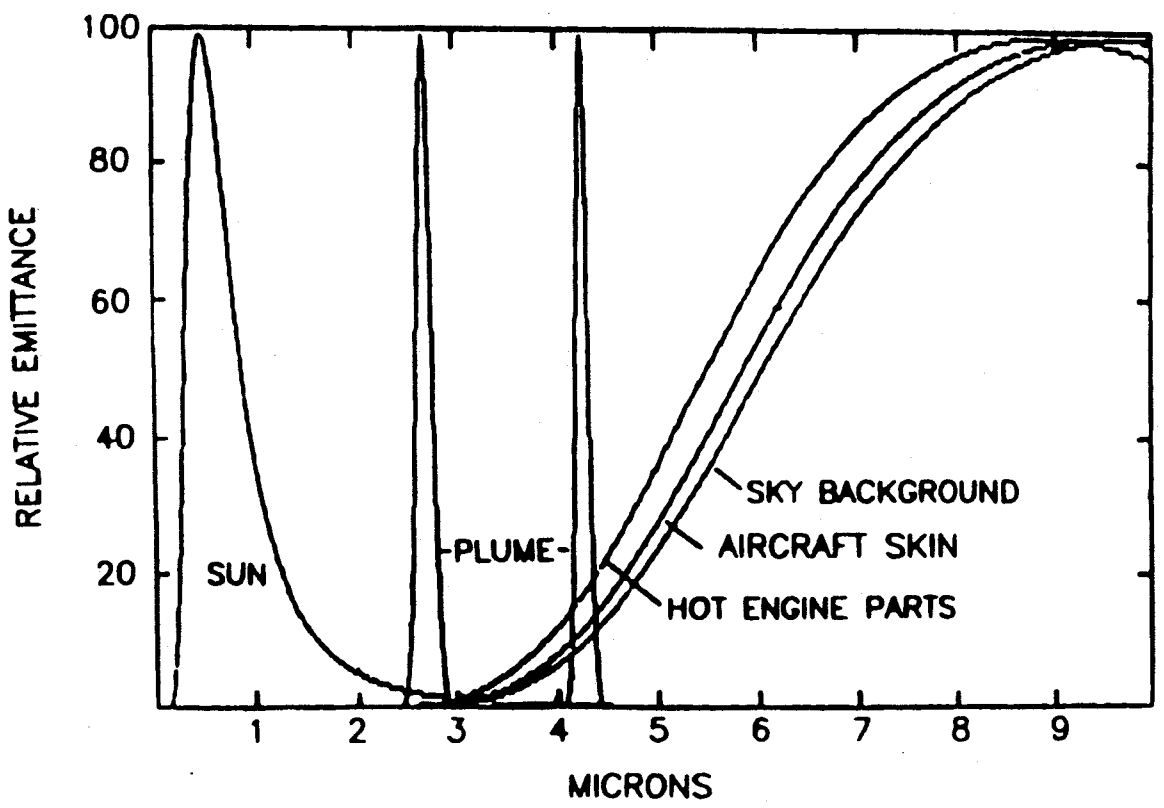
FIG. 9 illustrates the sun and background clutter radiance versus the radiance of an aircraft's exhaust plume.
Figure 10A:
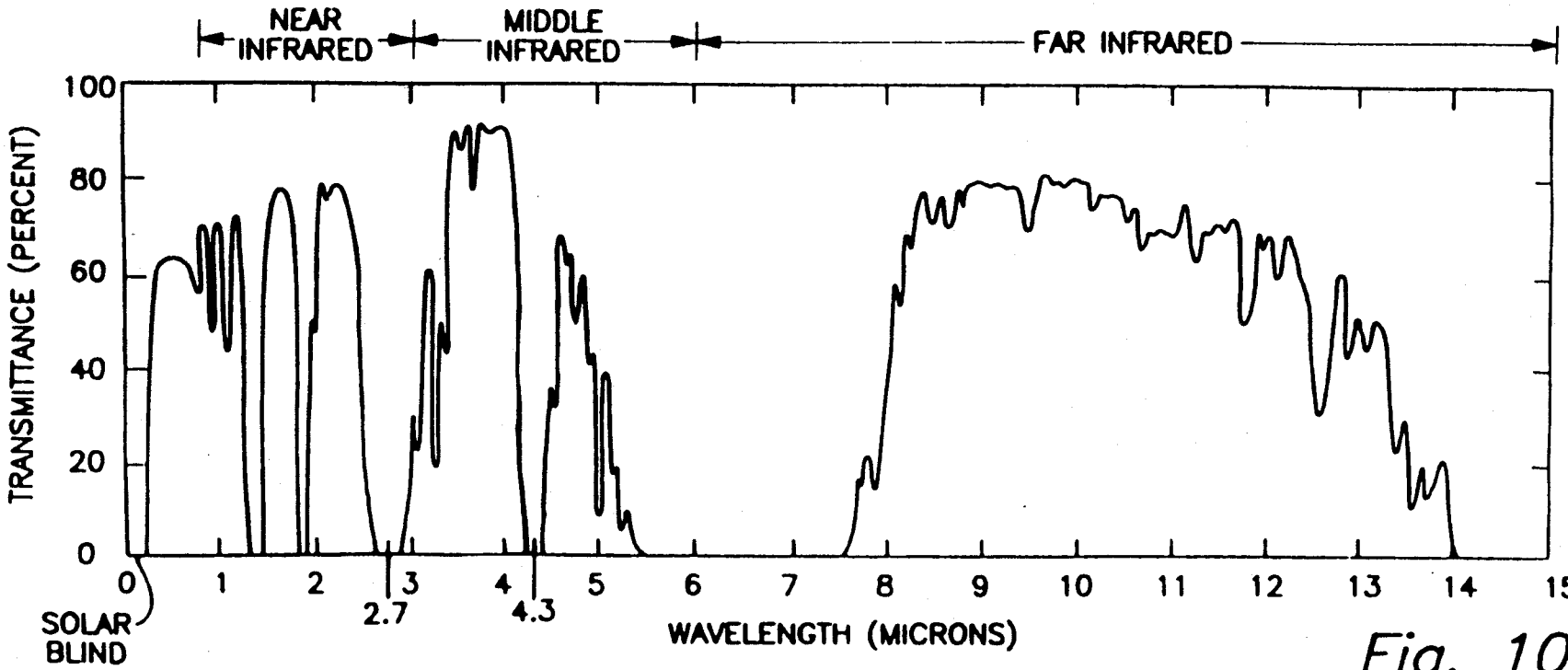
FIGS. 10*a* and 10*b* show the different absorption bands versus the percent transmittance of the sun's radiation.

The target detector array 620 is designed to have a filter 710 which will pass energy in the region from 4.2 microns to 4.3 microns. The pass band region for the target detector array filter 710 was calculated based upon data represented in FIGS. 9 and 10. FIG. 9 shows the background and target emissions produced by the sun and the exhaust plume. It should be noted that the sun's black body emission is reduced above 3 microns wave length while the $CO_2$ emission produced by the target plume is strong at 2.7 and 4.3 microns. FIG. 10*a* shows solar attenuation at sea level over a range of wave lengths from zero to 15 microns. Again, it should be noted that at 2.7 and 4.3 microns the atmospheric transmittance is approximately zero.

Figure 10B:
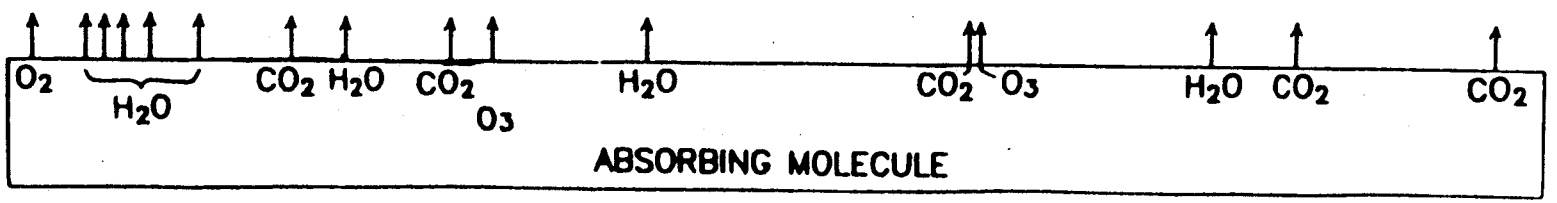

FIG. 10*b* shows the absorption wave bands of common atmospheric molecules including $CO_2$. By superimposing the absorption wave band of FIG. 10*b* on FIG. 10*a* it should be noted that the $CO_2$ absorption band lies directly over the 4.3 micron wave length. Therefore, the wave length of 4.3 microns has been chosen as the primary detection wave length since the solar radiation is significantly attenuated, yet the energy from the heated $CO_2$ exhaust is detectable at the edges of the $CO_2$ absorption band.

Figure 11:
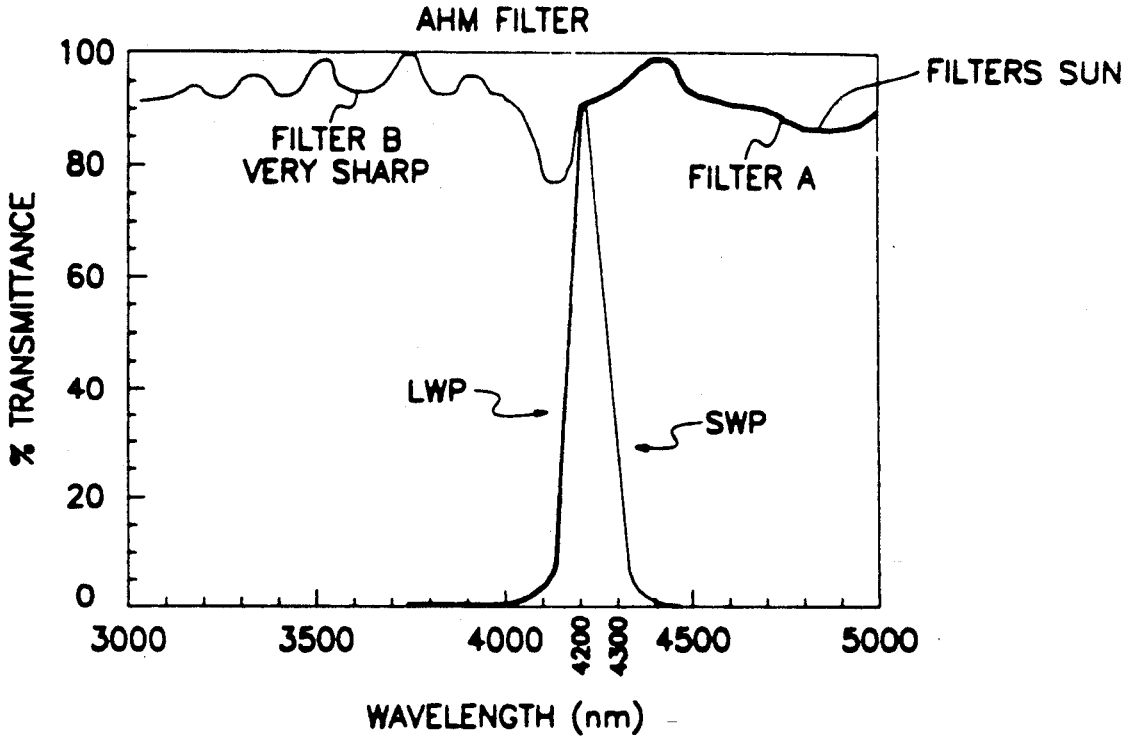
FIG. 11 demonstrates the long wave pass filter and short wave pass filter combination that is used in the filter array detector.
Figure 12:
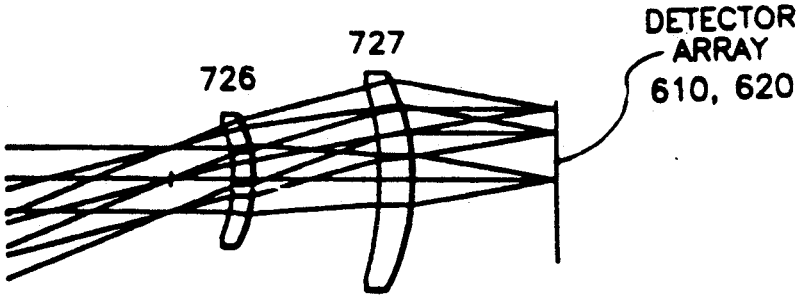
FIG. 12 illustrates the optics utilized by the sensor.

As shown in FIG. 11, filter 710 for target detector array 620 of FIG. 7 is designed with a long wave pass band filter A (LWP) and a short wave pass band filter B (SWP) combination. The required band width is so small that there are problems in depositing coatings for a narrow pass band filter. The problem of a narrow pass band filter is solved by overlapping SWP and LWP filters. FIG. 11 demonstrates a SWP filter B that cuts off at 4.3 μm and a LWP filter A that cuts on at 4.2 μm and does provide a good transmission notch. It should be noted that FIG. 11 shows the transmittance of each filter independently. Therefore, the actual transmittance in the notch would have to be obtained by multiplying the transmittances of the two filters. Each of these two filters would require many layers perhaps 15, or more, depending on which materials are used.

The most likely materials to use for filters such as this are ZnSe, ZnS, Ge, PbTe, $CaF_2$, $PbF_2$ and $SrF_2$. There are a number of other materials that could also be used. The final choice of materials is based upon the following considerations:

Use materials with a high index contrast to limit the number of layers required.

Use materials that deposit with minimal stress and/or with stresses that are nearly equal and opposite (tensile and compressive) so the net stress in a stack will be low.

Use materials with thermal expansion coefficients (TEC) that match each other and that of the substrate.

Use materials with low in-band absorption.

Depending on the final location of the filters it could also be necessary to use materials that are not hygroscopic. With all these important properties to consider, the final choices obviously will be selected after a trade-off analysis.

Both filters 710 for guard band array 610 and target detect array 620 for the preferred embodiment are purchased from Optical Coating Laboratories, Inc., Santa Rosa, Calif.

The invention is capable of operation with the sun in the field of view due to the combination of both a target detector array 620 and a guard band array 610. Filter 710 for guard band array 610 passes energy over the spectral band of 1 to 4 microns and consequently the detector is sensitive to the presence of either a flare or the sun. This is because the peak of solar and flare radiant emittance is near filter 710 for guard band array 610 spectral pass band and flux is emitted over a wide spectral band. The ratio of the sun's energy incident on the detector in the guard band wave length is 1,000 times the energy from the sun on the target detector array 620. On the other hand, when the arrays are scanned across the jet plume radiance there is much less energy incident on the array in the guard band filter region than over the narrow $CO_2$ band filter region. Consequently, jet plume radiation can be discriminated from false targets such as the sun, flares, and background clutter by standard two color techniques. This processing is accomplished utilizing CPU 135 of FIG. 6. The CPU 135 computes the ratio from the target detector array and the guard band array. A valid target will have a high ratio of energy from the target in the target detector band 4.2 μm to 4.3 μm to energy on the guard band array 610. Conversely, a false target will have a low ratio of energy on the target detector array 620 to energy on the guard band array 610. If a gray body clutter source has high enough radiance to exceed the threshold set for the target detector array 620 then the energy collected from that clutter background source will be much higher in the guard band array wave length from 1 to 4 microns, and consequently, background clutter will be rejected in the same manner as the sun and countermeasure flares. The only background clutter objects that could have enough energy to exceed the threshold on the target detection array are assumed to be specular glints from the sun off the water and other specular surfaces.

The cooling requirements for the detector system dictate that the detector reach an operating temperature of 250° Kelvin within two seconds of activation over a flight duration of ten seconds. The rapid cool down of the relatively large thermal load of the dual array system can be met by a Joule-Thompson type cooling unit.

Figure 13:
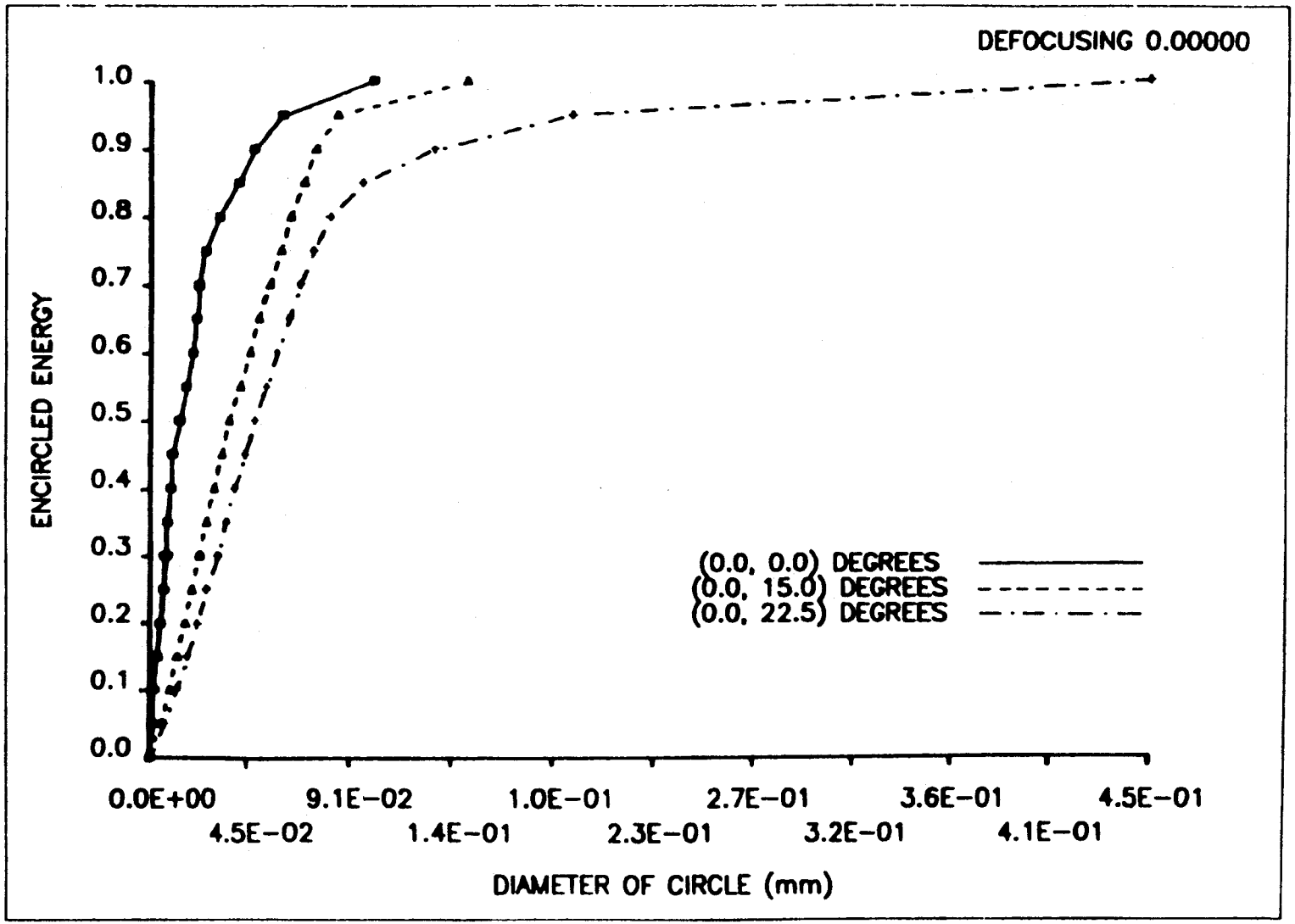
FIG. 13 illustrates the encircled energy for three field points for the optical elements.

The optical design approach of the preferred embodiment was driven by a desire for low cost and the overall system length requirement. This system consists of only two elements, a first positive meniscus lens 727 and a second positive meniscus lens 726. The back surface of both elements have a diffractive profile. A thin layer of IR plastic would be deposited onto the element surface and the diffractive profile replicated into it by a master. Diffractive surfaces with a 4-step profile have efficiencies in the 96% range. The encircled energy for three field points is shown in FIG. 13. The 80% encircled energy diameter for the full field is 0.1 millimeter, which corresponds to 2 milliradians. This system's F/# is F/2.8.

Optical requirements are design driven by the narrow filter band width, flat focal plane, and short path length. The telecentric optical design of FIG. 12 with two positive spherical meniscus lenses 726 and 727 and a binary micro lens optics 725 satisfies all requirements and design drivers. The back surface of each spherical optical element has an aspheric binary profile and a separate binary micro lens array 725 is located in front of each detector array as shown in FIG. 8. The micro lens array 725 increases the effective focal plane fill factor, reduces detector noise and permits the use of a smaller aperture and optical path length. The telecentric optical form is the preferred approach in this design since it provides small incident angles which is required for narrow band interference filters. The telecentric design also has a flat focal plane which permits the use of a low cost focal plane array. Binary coatings on the optical spherical surfaces are used as a cost effective substitute for aspheric lens. The prescriptions for the two positive spherical meniscus lenses 726 and 727 are given in Appendix A. The information in Appendix A is in Code V.

APPENDIX A

CODE V
HELO F/2.8

| OBJ: | RDY INFINITY | | THI INFINITY | RMD | GLA | CCY 100 | THC 100 | GLC |
|---|---|---|---|---|---|---|---|---|
| | | | LENS 726 | | | | | |
| STO: | 51.51530 | | 6.000000 | | SILICN_SPECIAL | 0 | 100 | |
| 2: | 60.11660 | | 31.172470 | | AIR | 0 | 0 | |
| HOE: | | | | | | | | |
| HV1: | REA | HV2: | REA | HOR: | 1 | | | |
| HX1: | 0.000000E+00 | HY1: | 0.000000E+00 | HZ1: | 0.100000E+21 | | | |
| CX1: | 100 | CY1: | 100 | CZ1: | 100 | | | |
| HX2: | 0.000000E+00 | HY2: | 0.000000E+00 | HZ2: | 0.100000E+21 | | | |
| CX2: | 100 | CY2: | 100 | CZ2: | 100 | | | |
| HWL: | 2500.00 | HTO: | SPH | HNO: | 27 | | | |
| HCO/HCC | | | | | | | | |
| C3: | −2.6318E-04 | C5: | −2.6318E-04 | C10: | 4.2105E-07 | | | |
| C3: | 0 | C5: | 0 | C10: | 0 | | | |
| C12: | 8.4209E-07 | C14: | 4.2105E-07 | C21: | 1.3465E-09 | | | |
| C12: | 0 | C14: | 0 | C21: | 0 | | | |
| C23: | 4.0394E-09 | C25: | 4.0394E-09 | C27: | 1.3465E-09 | | | |
| C23: | 0 | C25: | 0 | C27: | 0 | | | |
| | | | LENS 727 | | | | | |
| 3: | 145.89976 | | 6.000000 | | SILICN_SPECIAL | 0 | 100 | |
| 4: | 363.87441 | | −58.268429 | | | 0 | 0 | |
| HOE: | | | | | | | | |
| HV1: | REA | HV2: | REA | HOR: | 1 | | | |
| HX1: | 0.000000E+00 | HY1: | 0.000000E+00 | HZ1: | 0.100000E+21 | | | |
| CX1: | 100 | CY1: | 100 | CZ1: | 100 | | | |
| HX2: | 0.000000E+00 | HY2: | 0.000000E+00 | HZ2: | 0.100000E+21 | | | |
| CX2: | 100 | CY2: | 100 | CZ2: | 100 | | | |
| HWL: | 2500.00 | HTO: | SPH | HNO: | 27 | | | |
| HCO/HCC | | | | | | | | |
| C3: | −6.5348E-04 | C5: | −6.5348E-04 | C10: | 6.6769E-07 | | | |
| C3: | 0 | C5: | 0 | C10: | 0 | | | |
| C12: | 1.3354E-06 | C14: | 6.6769E-07 | C21: | 2.1846E-09 | | | |
| C12: | 0 | C14: | 0 | C21: | 0 | | | |
| C23: | 6.5537E-09 | C25: | 6.5537E-09 | C27: | 2.1846E-09 | | | |
| C23: | 0 | C25: | 0 | C27: | 0 | | | |
| 5: | INFINITY | | 90.095958 | | | 100 | 0 | |
| IMG: | −90.09567 | | 0.000000 | | | 0 | 100 | |

SPECIFICATION DATA

| | | | |
|---|---|---|---|
| EPD | 20.00000 | | |
| DIM | MM | | |
| WL | 2400.00 | 2200.00 | 2000.00 |
| REF | 2 | | |
| WTW | 1 | 1 | 1 |
| INI | BSF | | |
| XAN | 0.00000 | 0.00000 | 0.00000 |
| YAN | 0.00000 | 15.00000 | 22.50000 |
| VUX | 0.00000 | 0.00000 | 0.00000 |
| VLX | 0.00000 | 0.00000 | 0.00000 |
| VUY | 0.00000 | 0.00000 | 0.00000 |
| VLY | 0.00000 | 0.00000 | 0.00000 |

APERTURE DATA/EDGE DEFINITIONS

| | |
|---|---|
| CA | |
| CIR S1 | 10.000000 |

REFRACTIVE INDICES

| | | | |
|---|---|---|---|
| GLASS CODE | 2400.00 | 2200.00 | 2000.00 |
| SILICN_SPECIAL | 3.441408 | 3.446254 | 3.452672 |

No solves in defined in system

This is a decentered system. If elements with power are decentered or tilted, the first order properties are probably inadequate in describing the system characteristics.

INFINITE CONJUGATES

-continued

| | |
|---|---|
| EFL | 60.8713 |
| BFL | 92.6879 |
| FFL | −44.0541 |
| FNO | 3.0436 |
| IMG DIS | 90.0960 |
| OAL | −15.0960 |
| PARAXIAL IMAGE | |
| HT | 25.2137 |
| ANG | 22.5000 |
| ENTRANCE PUPIL | |
| DIA | 20.0000 |
| THI | 0.0000 |
| EXIT PUPIL | |
| DIA | 27.6348 |
| THI | 8.5797 |

CODE V CONVERSION TABLE

Coefficients for describing "aspheric" phase departure from pure 2-point construction configuration for HOE type surface Sk, using a polynomial in X, Y on the surface of the substrate. Evaluation of the polynomial gives the OPD (in lens units, at the construction wavelength HWL) to be added to the aberrations of the 2-point HOE. These coefficients are normally the result of an AUTOMATIC DESIGN run in which they are varied, rather than user defined. Coefficients are for monomials in ascending order up to 10th order, starting with the 1st order:

| | | | |
|---|---|---|---|
| C1 | X | C21 | $X^6$ |
| C2 | Y | . | . |
| | | . | . |
| C3 | $X^2$ | C27 | $Y^6$ |
| C4 | XY | C28 | $X^7$ |
| C5 | $Y^2$ | . | . |
| | | . | . |
| C6 | $X^3$ | C35 | $Y^7$ |
| C7 | $X^2Y$ | C36 | $X^8$ |
| C8 | $XY^2$ | . | . |
| | | . | . |
| C9 | $Y^3$ | C44 | $Y^8$ |
| C10 | $X^4$ | C45 | $X^9$ |
| C11 | $X^3Y$ | . | . |
| | | . | . |
| C12 | $X^2Y^2$ | C54 | $Y^9$ |
| C13 | $XY^3$ | C55 | $X^{10}$ |
| C14 | $Y^4$ | . | . |
| | | . | . |
| C15 | $X^5$ | C65 | $Y^{10}$ |
| . | . | | |
| . | . | | |
| C20 | $Y^5$ | | |

The term j can be calculated from:

$$J=\{(m+n)2+m+3n\}/2$$

where m, n are the powers of X, Y respectively; j must not exceed 65. See HNO for a way to "turn off" coefficients from being included in the polynomial.

We claim:

1. In a munition system for intercepting a target wherein said system comprises a base platform dispenser and a right circular cylinder having a circular periphery, forward and back parallel end faces, and a longitudinal axis, wherein said dispenser includes means for spinning said cylinder about said longitudinal axis and for launching said spinning cylinder along a preselected path with said longitudinal axis being in a preselected orientation with respect to a set of reference axes, said cylinder comprising:

a) controllable propulsion means on the periphery of said cylinder for propelling said cylinder in a plane normal to said longitudinal axis;

b) target sensing means on said forward end face of said cylinder, said target sensing means for sensing said target's location with respect to said cylinder and said set of reference axes;

c) a magnetometer carried by said cylinder, said magnetometer for sensing said cylinders rotational motion relative to said longitudinal axis; and d) proportional navigation means carried by said cylinder, said navigation means comprising a first and a second accelerometer pair for sensing precessional motion of said cylinder, said magnetometer providing said cylinder's rotational motion relative to said longitudinal axis to said navigation means, said target sensing means providing the target's location with respect to said set of reference axes to said navigation means, said navigation means determining said target sensing means error induced by rotational and precessional motion, wherein said navigational means controls said propulsion means.

2. The munition system of claim 1 wherein said target sensing means is an infrared sensor.

3. The munition system of claim 1 wherein said controllable propulsion means is at least one reaction jet comprising:

a gas generator for producing a high pressure gas;

a plenum for distributing said high pressure gas; and valve operated jet, said jet being opened and closed by said navigation means, thereby venting said high pressure gas.

4. The munition system of claim 3 wherein said controllable propulsion means provides continuous propulsion.

5. The munition system of claim 1 wherein said proportional navigation means further comprises a first and a second compensation circuit and wherein:

said first compensation circuit sums a first signal provided by said first accelerometer pair, said first compensation circuit integrating the sum of said first signal;

said second compensation circuit sums a second signal provided by said second accelerometer pair, said second compensation circuit integrating the sum of said second signal; and said navigation means calculates said target sensing means error with the integrated sums of said first and second signals.

6. The munition system of claim 5 wherein said magnetometer provides information of said cylinder's rotational motion to said compensation circuit.

7. The munition system of claim 6 wherein said controllable propulsion means is a reaction jet comprising:

a gas generator for producing a high pressure gas;

a plenum for distributing said high pressure gas; and valve operated jets, said jets being opened and closed by said navigation means and venting said high pressure gas.

8. The munition system of claim 7 wherein said controllable propulsion means provides continuous propulsion.

9. The munition system of claim 1 wherein said controllable propulsion means is a plurality of solid thrusters, said thrusters being ignited by said navigation means to propel said cylinder.

10. The munition system of claim 6 wherein said controllable propulsion means is a plurality of solid thrusters, said thrusters being ignited by said navigation means to propel said cylinder.

11. In a munition system for intercepting a target wherein said system comprises a base platform dispenser and a platform, forward and back end faces, and a longitudinal axis, wherein said dispenser includes means for spinning said platform about said longitudinal axis and for launching said spinning platform along a preselected path with said longitudinal axis being in a preselected orientation with respect to a set of reference axes, said platform comprising:

a) controllable propulsion means on the periphery of said platform for propelling said platform in a plane normal to said longitudinal axis;

b) target sensing means on said forward end face of said platform, said target sensing means for sensing said target's location with respect to said platform and said set of reference axes;

c) a magnetometer carried by said platform, said magnetometer for sensing said platform's rotational motion relative to said longitudinal axis; and d) navigation means carried by said platform, said navigation means comprising a first and a second accelerometer pair for sensing precessional motion of said platform, said magnetometer providing said platform's rotational motion relative to said longitudinal axis to said navigation means, said target sensing means providing the target's location with respect to said set of reference axes to said navigation means, said navigation means determining said target sensing means error induced by rotational and precessional motion, wherein said navigation means controls said propulsion means.

12. The munition system of claim 11 wherein said target sensing means is an infrared sensor.

13. The munition system of claim 11 wherein said controllable propulsion means is at least one reaction jet comprising:

a gas generator for producing a high pressure gas;

a plenum for distributing said high pressure gas; and valve operated jet, said jet being opened and closed by said navigation means, thereby venting said high pressure gas.

14. The munition system of claim 13 wherein said controllable propulsion means provides continuous propulsion.

15. The munition system of claim 11 wherein said navigation means further comprises a first and a second compensation circuit and wherein:

said first compensation circuit sums a first signal provided by said first accelerometer pair, said first compensation circuit integrating the sum of said first signal;

said second compensation circuit sums a second signal provided by said second accelerometer pair, said second compensation circuit integrating the sum of said second signal; and said navigation means calculates said target sensing means error with the integrated sums of said first and second signals.

16. The munition system of claim 15 wherein said magnetometer provides information of said platform's rotational motion to said compensation circuit.

17. The munition system of claim 16 wherein said controllable propulsion means is a reaction jet comprising:

a gas generator for producing a high pressure gas;

a plenum for distributing said high pressure gas; and valve operated jets, said jets being opened and closed by said navigation means and venting said high pressure gas.

18. The munition system of claim 17 wherein said controllable propulsion means provides continuous propulsion.

19. The munition system of claim 11 wherein said controllable propulsion means is a plurality of solid thrusters, said thrusters being ignited by said navigation means to propel said platform.

20. The munition system of claim 16 wherein said controllable propulsion means is a plurality of solid thrusters, said thrusters being ignited by said navigation means to propel said platform.

* * * * *